United States Patent [19]

Luperti et al.

[11] 3,974,749

[45] Aug. 17, 1976

[54] ENVELOPE FLAP SEPARATING AND DISTENDING METHOD AND MECHANISM

[75] Inventors: Harry E. Luperti, Wilton; Robert Irvine, Riverside; Edward R. Hordeski, Stamford, all of Conn.

[73] Assignee: Pitney-Bowes, Inc., Stamford, Conn.

[22] Filed: Aug. 21, 1975

[21] Appl. No.: 606,602

[52] U.S. Cl. ..... 93/61 R; 53/382; 93/84 R

[51] Int. Cl.[2] ..... B31B 1/26; B31B 49/04

[58] Field of Search ..... 93/61 R, 62, 63 R, 63 M, 93/61 A, 61 B, 84 R, 84 TW; 53/381 R, 382, 384

[56] References Cited

UNITED STATES PATENTS

| | | | |
|---|---|---|---|
| 2,668,053 | 2/1954 | Bach | 53/381 R X |
| 2,939,261 | 6/1960 | Calhoun | 53/381 R |
| 3,015,926 | 1/1962 | Galambos | 53/384 |
| 3,143,838 | 8/1964 | Pouliart | 53/381 R X |
| 3,395,624 | 8/1968 | Seyl | 93/61 R |
| 3,935,800 | 2/1976 | Sette et al. | 93/61 R |

*Primary Examiner*—James F. Coan
*Attorney, Agent, or Firm*—William D. Soltow, Jr.; Albert W. Scribner; Robert S. Salzman

[57] ABSTRACT

A flap separating mechanism and method for distending a flap from a body portion of an envelope.

An envelope moving through a mail handling system may require its flap to be moistened and sealed. As a prelude to the moistening procedure, the flap of the envelope must be separated from the body portion. The separating mechanism disclosed herein comprises a pair of axially adjacent rotatable rollers. One of the rollers is positioned at a higher elevation with respect to the other roller, thus forming a body deforming bite for an incoming envelope. One of the rollers is movable with respect to the other roller in order to accommodate for varying envelope thicknesses.

10 Claims, 2 Drawing Figures

ENVELOPE FLAP SEPARATING AND DISTENDING METHOD AND MECHANISM

This invention pertains to flap separating mechanisms, and more particularly to a flap separating mechanism and method which deforms the body portion of a vertically or horizontally oriented envelope in order to provide distention of the flap from the body of the envelope.

BACKGROUND OF THE INVENTION

With the modern day need for high speed mail handling systems, it has been found useful to transport envelopes along a mail handling feed path with a vertical orientation. This vertical orientation requires that many basic functions provided by prior machines, such as moistening and sealing of the envelope, require new mechanisms due to the differences in the mail handling orientation.

As a prelude to the moistening of envelope flaps, it is required that the flap be separated from the body portion of the envelope. With the vertical orientation of the moving piece of mail, it has been discovered that the flap of an envelope can be distended from the body of the letter by deforming the envelope about its flap end.

In a prior device, a force was applied to the back of an envelope causing the body of the envelope to flex. This flexing resulted in separating the flap from the letter. Such a device is shown in application Ser. No. 459,037; filed: Apr. 8, 1974, now U.S. Pat. No. 3,935,800.

This prior device posed several problems. In the first instance, it did not work properly for thick pieces of mail. An adequate flap separating force for thin envelopes, was too weak to break the back of heavier and thicker pieces of mail.

Secondly, this prior device was over thirteen inches long, making it difficult to fit into a small mail-handling machine.

The present inventive mechanism and method, can handle a wide range of envelope thicknesses. The envelope flap is more positively separated and distended by deforming the letter rather than applying an instantaneous force to it. The invention contemplates deforming the envelope in the bite of two axially adjacent rollers.

The present apparatus has many other advantages over the previous device, in that it is more compact; has fewer parts; is quieter; and simultaneously moves the envelope along the feed path, while distending the flap.

SUMMARY OF THE INVENTION

The invention relates to a method and mechanism for separating and distending a flap from the body portion of an unsealed envelope. An envelope having a vertical orientation is introduced into the bite of two axially adjacent rotatable rollers. The flap end of the envelope is wedged between the rollers in order to deform the body portion of the letter about the flap end. This in turn creates a separation and distension of the flap from the body of the envelope. One of the rollers is movable to accommodate for different thicknesses of envelope. One of the rollers is positioned at a higher elevation with respect to the other roller to give the proper bite necessary to distend the flap.

It is an object of this invention to provide an improved envelope flap separating and distending apparatus and method;

It is another object of the invention to provide an envelope flap separating and distending apparatus and method that can accommodate different thicknesses of envelope; and It is a further object of this invention to provide a more positive acting and more compact envelope flap separating and distending apparatus.

These and other objects of the invention will be better understood and will become more apparent with reference to the following detailed description taken in conjunction with the attached drawings, in which:

FIG. 1 is a perspective view of one species of the flap separating and distending apparatus of this invention, with another embodiment shown in phantom; and FIG. 2 is a perspective view of a second species of a flap separating and distending apparatus in accordance with the invention.

DETAILED DESCRIPTION

Figure 1:
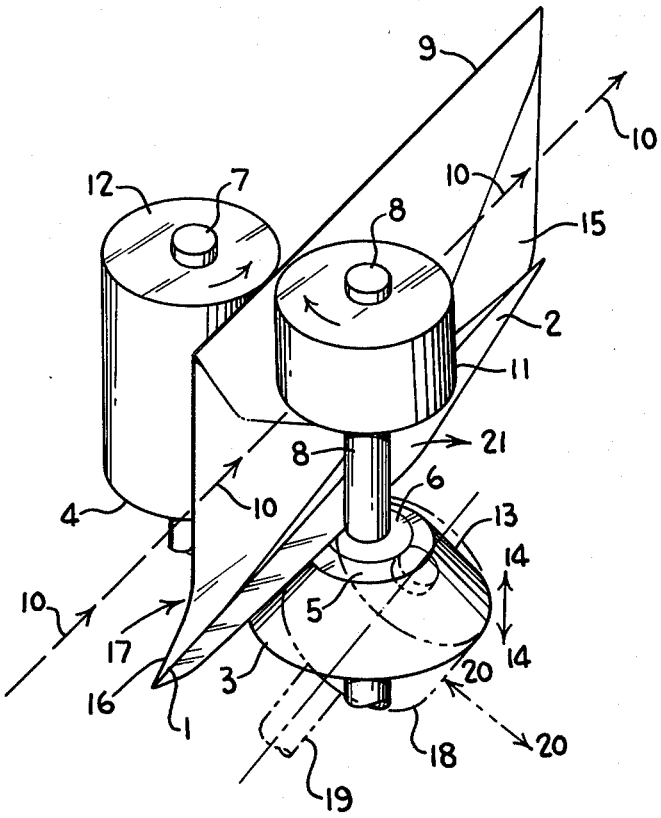

Now referring to FIG. 1, an envelope 9 is shown moving along a feed path designated by arrows 10. A pair of rollers 11 and 12, respectively, rotate to propel the letter 9 along the feed path 10. Roller 11 is rotatably mounted on shaft 8, and roller 12 is rotatably mounted on shaft 7. Mounted below roller 11 on shaft 8 is a beveled-shaped roller 13. Roller 13 is both rotatably and slidably (arrows 14) mounted on shaft 8 by means of bearing 6. The bottom edge 4 of roller 12 is disposed a short distance above the flap hinge line 1 of the envelope 9. The edge 4 is also disposed above the bottom edge 3 of roller 13, but below its top edge 5. The roller 13 is spring-biased upward to provide a slight gap between rollers 12 and 13. This gap is large enough to allow the flap end of thin envelopes to move between the rollers. Thicker envelopes will cause the roller 13 to move downwardly against its biasing (arrows 14) to accommodate for their greater thickness (increase the gap between rollers 12 and 13).

When an incoming envelope 9 first enters the bite between rollers 12 and 13, its flap end 16 is wedged between these rollers. This causes the body portion 15 of the envelope to deform as illustrated by arrow 17. This in turn causes flap 2 to separate and distend from the body 15 of envelope 9. The flap 2 is able to distend (arrow 21) because the beveled surface of roller 13 provides sufficient spacing for the flap displacement.

Another embodiment of this apparatus is shown in phantom. A cylindrical roller 18 is rotatably mounted on shaft 19 in place of roller 13. Because the cylindrical roller 18 is mounted at an angle with respect to roller 12, it provides the same spacing necessary for the flap displacement as was provided by the beveled surface of roller 13. However, in order for rollers 12 and 18 to accommodate a range of envelope thicknesses, roller 18 is movable transversely (arrows 20) of its rotatable axis. Roller 18 is spring-biased towards roller 12, and provides a gap for thin envelopes in its extreme biased position. The roller 18 moves against the biasing (arrows 20) to accommodate thicker envelopes.

Figure 2:
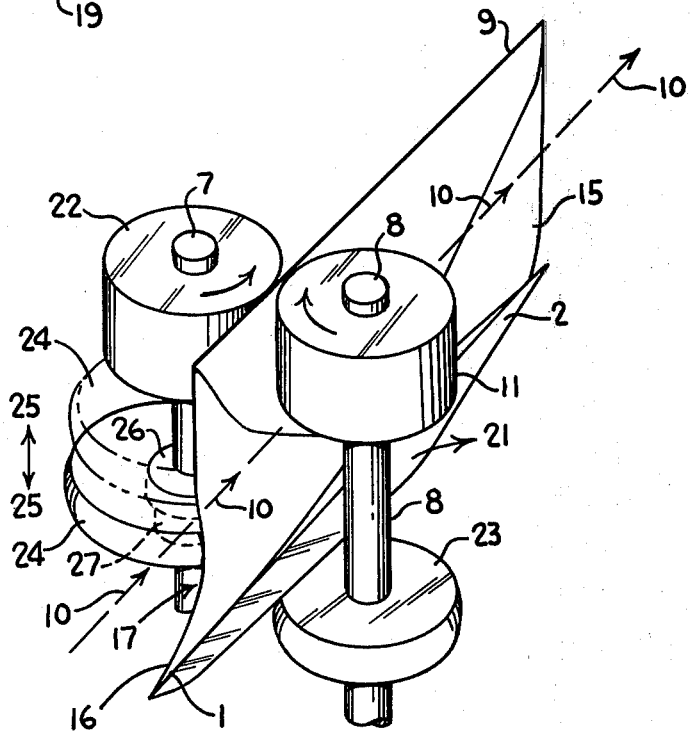

FIG. 2, shows a second species of apparatus in accordance with the invention. Like parts have been given the same numeral as an aid to furthering the reader's understanding.

An incoming envelope 9 is propelled along feed path 10 by means of rollers 11 and 22. Roller 11 is rotatably mounted on shaft 8, and roller 22 is rotatably mounted on shaft 7.

Two gap forming rollers 23 and 24, respectively, are rotatably mounted on shafts 8 and 7, respectively, as shown. Roller 23 while being rotatable, is stationary with respect to its position along shaft 8. Roller 24, however, is free to slide along shaft 7 (arrows 25) by means of slide bearing 26. In its lowest position, roller 24 provides a gap between rollers 23 and 24, which allows for thinner envelopes to move between the rollers. Roller 24 is not biased, and is free to slidably move upwardly to accommodate thicker pieces of mail. A stop 27 located on shaft 7 defines the lowest position for roller 24, and hence, the gap distance for thin pieces of mail. The phantom lines denote an upper position for roller 24, which can accommodate thicker envelopes.

When an incoming envelope 9 first enters the bite between rollers 23 and 24, its flap end 16 is wedged between these rollers. This causes the body portion 15 of the envelope to deform as depicted by arrow 17. This results in separating and distending flap 2 of the envelope from its body portion 15.

The flap 2 is able to distend because roller 23 is very thin, and has a rounded edge as shown.

As with roller 12 in FIG. 1, roller 24 is at a higher elevation than roller 23 (even in its lowest position). This disparity in roller levels, is what helps to create the wedging effect similar to that shown in FIG. 1.

It is obvious from observing the apparatuses in FIGS. 1 and 2, that sealed envelopes will pass through the rollers without having their flaps 2 separated. In fact, the sealed flaps will actually be forced together by the inventive rollers.

Also, it will be seen that the flaps of unsealed envelopes will be distended simultaneously with being propelled along the feed path (on-the-fly). These apparatuses, therefore, supply a more reliable and automatic flap separation and distension than previous devices.

Furthermore, the inventive apparatuses are more compact and allow for ease of mounting and assembly in mail-handling machines.

Many modifications and changes in the apparatus will naturally occur to the skilled practitioner in this art.

For example, while the present apparatus was designed to process vertically oriented mail, it can easily be used to handle horizontally oriented mail. This is accomplished by arranging the apparatus to extend horizontally rather than vertically as shown.

The invention is deemed to encompass those changes which are obvious; the spirit and scope of the invention being represented by the appended claims.

We claim:

1. A method for separating and distending a flap from a body portion of an unsealed envelope moving along a feed path, said method comprising the steps of:

A. moving an unsealed envelope along a feed path;

B. introducing a flap end of the unsealed envelope into the bite of two axially adjacent, rotatable rollers; and C. causing a flap end of said envelope to wedge between said rollers in order to deform the body portion of the envelope about said flap end and thereby create a separation and distension of the flap from the body portion of said envelope.

2. The method of claim 1, further comprising the step of:

D. moving one of said two rollers in an axial plane with respect to the other one of said two rollers when the envelope is in the bite of said rollers in order to accommodate for the thicknesses of the envelope.

3. The method of claim 1, further comprising the step of:

D. moving one of said two rollers in a transverse plane with respect to the other one of said two rollers when the envelope is in the bite of said rollers, in order to accommodate for the thicknesses of the envelope.

4. The method of claim 1, further comprising the steps of:

D. simultaneously moving said envelope along an envelope feed path as said flap is caused to separate and distend from the body portion of said envelope.

5. A flap separating mechanism for distending a flap from a body portion of an unsealed envelope as said envelope moves along a feed path, said flap separating mechanism comprising:

A. means defining an envelope feed path wherein the envelope is transported along said feed path;

B. a pair of axially adjacent, rotatable rollers disposed along said envelope feed path and forming a bite for a flap end of an incoming envelope, one of said pair of rollers being positioned at a higher elevation with respect to the other one of said pair of rollers, whereby the flap end of said envelope will wedge betwen said rollers causing the body portion of the envelope to deform about said flap end and thereby create a separation and distension of the flap from the body portion of said envelope.

6. The flap separating mechanism of claim 5, wherein one of said pair of rollers is movable in an axial plane with respect to the other one of said pair of rollers.

7. The flap separating mechanism of claim 5, wherein one of said pair of rollers is movable in a transverse plane with respect to its rotatable axis.

8. The flap separating mechanism of claim 5, wherein one of said pair of rollers is bevel-shaped.

9. The flap separating mechanism of claim 6, wherein said movable roller is biased against its axial movement.

10. The flap separating mechanism of claim 7, wherein said movable roller is biased against its transverse movement.

* * * * *